United States Patent [19]

Pringle

[11] Patent Number: 4,598,773

[45] Date of Patent: Jul. 8, 1986

[54] FAIL-SAFE WELL SAFETY VALVE AND METHOD

[75] Inventor: Ronald E. Pringle, Houston, Tex.

[73] Assignee: Camco, Incorporated, Houston, Tex.

[21] Appl. No.: 678,125

[22] Filed: Dec. 4, 1984

Related U.S. Application Data

[63] Continuation-in-part of Ser. No. 588,609, Mar. 12, 1984, Pat. No. 4,495,998, and Ser. No. 580,484, Feb. 15, 1984.

[51] Int. Cl.[4] ..... E21B 34/10

[52] U.S. Cl. ..... 166/373; 166/321

[58] Field of Search ..... 166/373, 374, 375, 386, 166/319–321, 332, 334

[56] References Cited

U.S. PATENT DOCUMENTS

| | | | |
|---|---|---|---|
| 2,921,601 | 1/1960 | Fisher, Jr. | 166/321 X |
| 3,860,069 | 1/1975 | Wray et al. | 166/321 X |
| 4,294,314 | 10/1981 | Miyagishima et al. | 166/321 X |
| 4,503,913 | 3/1985 | Carmody | 166/321 X |

*Primary Examiner*—Stephen J. Novosad

*Assistant Examiner*—Thuy M. Bui

*Attorney, Agent, or Firm*—Fulbright & Jaworski

[57] ABSTRACT

A well safety valve having a piston and cylinder assembly which is connected to and actuated by a hydraulic control line extending to the well surface for moving the valve to an open position in which the hydrostatic head in the control line is balanced by a fluid column exposed to the opposite side of the assembly acting to close the valve. The fluid column has a greater density than the hydraulic fluid in the control line for biasing the valve to the closed position. The volume of fluid in the fluid column is greater than the volume of fluid in the control line whereby exposure of the fluid column to gas will not substantially change its density. The housing includes a container in communication between the other side of the assembly and the fluid column and contains a grease for protecting the assembly. The grease has a density less than the density of the fluid column and is of a volume greater than the volume displaced in the assembly upon actuation of the piston and cylinder.

10 Claims, 7 Drawing Figures

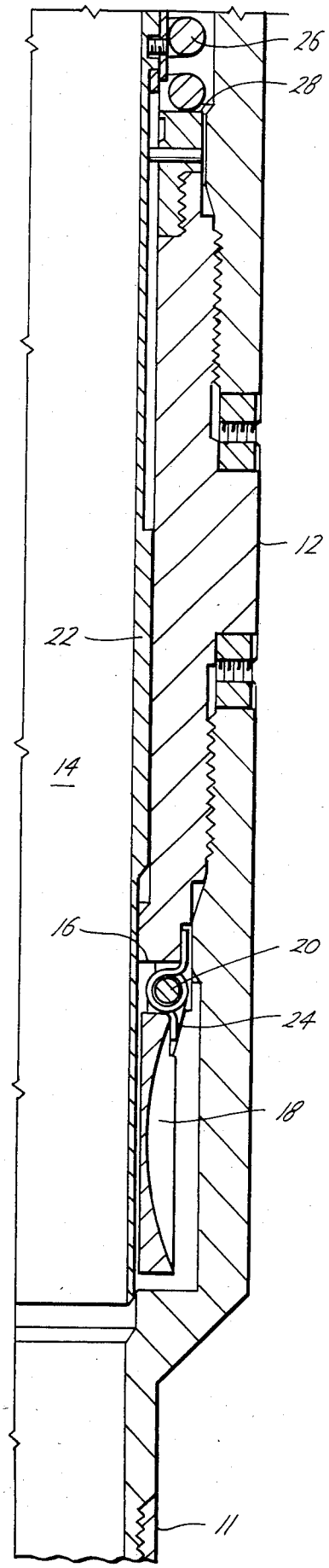
Fig. 1E
Fig. 2
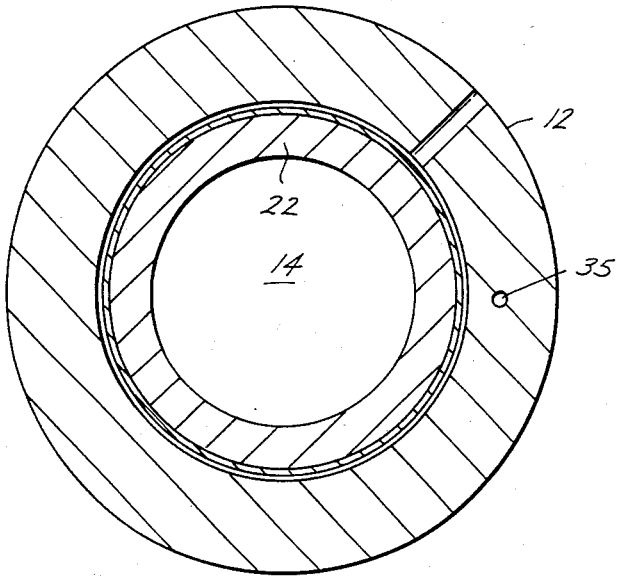
Fig. 3
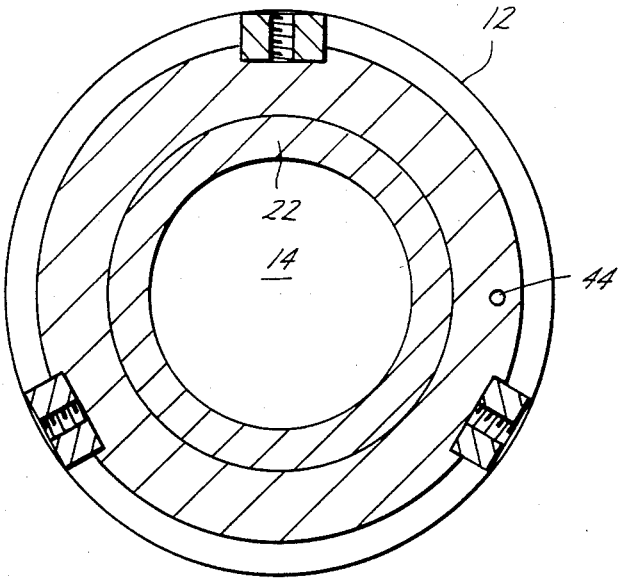

FAIL-SAFE WELL SAFETY VALVE AND METHOD

CROSS-REFERENCE TO RELATED APPLICATIONS

This application is a continuation-in-part of application Ser. No. 580,484, filed Feb. 15, 1984, entitled "Safety Valve Responsive to Tubing Pressure", now abandoned, and to patent application Ser. No. 588,609, filed Mar. 12, 1984, entitled "Tubing Pressure Balanced Well Safety Valve", now U.S. Pat. No. 4,495,998.

BACKGROUND OF THE INVENTION

As oil and gas well completion technology is being extended to greater and greater depths, the need for an improved deep set safety valve increases. Generally, well safety valves are actuated to the open position by a piston and cylinder assembly in response to hydraulic fluid applied to a hydraulic control line extending from the safety valve to the well surface. As the depth at which the safety valve is set increases, the hydrostatic head in the fluid control line to the piston and cylinder assembly increases and must be overcome in order to close the safety valve. In designing safety valves, the tubing pressure as a closing force should not be relied upon since it may not always be there or may be quite variable. Therefore, the safety valve must have another energy source to insure that the safety valve will be fail-safe and will close under all conditions. Another type of closing force has been provided by utilizing a biasing spring action to close the valve. However, the maximum spring force that can be provided is limited and therefore is not sufficient in deep set wells to overcome the hydrostatic opposing force in the control line. Another proposed solution to compensating for the hydrostatic head in the control line is to provide a second or balance line which is connected to the second side of the piston and cylinder assembly and which extends to the well surface to provide a balancing hydrostatic head on the piston and cylinder assembly. Theoretically, this solution would be successful if the various seals in the safety valve never fail. However, in the event of a seal failure, gas in the well fluid would migrate into the balancing line, dilute the density of the balancing hydrostatic head resulting in unbalancing of the hydrostatic head forces thereby preventing the valve from closing.

The present invention is directed to a fail-safe safety valve and method of operation to insure that the hydrostatic head in the hydraulic control line is balanced, and preferably is overbalanced to provide a fail-safe closing force while at the same time the piston and cylinder assembly is protected from the balancing fluid, and the balancing fluid is not subjected to having its density diluted to an extent that it is unable to provide a fail-safe closing force.

SUMMARY

The present invention is directed to a method for compensating for the effects of the hydrostatic head on a well tool operated in a well by a piston and cylinder assembly and actuated by a hydraulic fluid control line connected to one side of the assembly and extending to the well surface. The method comprehends exposing the second side of the assembly to a fluid column having substantially the same hydrostatic head as the head in the control line, but wherein the fluid column has a greater volume of fluid than the volume of hydraulic fluid in the control line whereby exposure of the fluid column to gas will not substantially change its density.

The method of the present invention also includes wherein the density of the fluid column is greater than the density of the hydraulic fluid in the control line thereby providing a closing biasing force acting on the piston and cylinder assembly.

Still a further object of the present invention is the provision of placing a barrier fluid between the second side of the assembly and the fluid column for protecting the assembly from the fluid in the fluid column.

Still a further object of the present invention is wherein the volume of the barrier fluid is greater than the volume displaced by actuation of the piston and cylinder assembly whereby the barrier fluid will remain in place between the assembly and the fluid column.

Still a further object of the present invention is wherein the density of the barrier fluid is less than the density of the fluid in the fluid column.

A further object of the present invention is the improvement in a well safety valve for controlling the fluid flow through a well conduit and including a tubular housing and a valve closure member moving between open and closed positions in which a piston and cylinder assembly is positioned in the housing and connected to the valve closure member for moving the valve closure member. One side of the assembly is adapted to be connected to a hydraulic control line extending to the well surface for moving the valve closure member to the open position. The improvement comprises means for compensating for the hydrostatic pressure in the control line by providing a container in the housing in communication between the other side of the assembly and the outside of the housing and adapted to being exposed to a fluid column outside of the housing which extends to the well surface for hydrostatically compensating for the hydrostatic pressure in the control line. A barrier fluid is provided in the container for limiting the access of the fluid with the assembly, and the container has a restriction between the barrier fluid and the outside of the housing for retaining the barrier fluid in the container.

Still a further object is wherein the volume of the container is greater than the volume displaced in the assembly upon actuation of the piston and cylinder assembly whereby the container will retain barrier fluid as the assembly is operated.

Still a further object is wherein the container includes a tubular member.

A further object is wherein the density of the barrier fluid is less than the density of the fluid in the fluid column whereby the barrier fluid is retained in the container. The density of the hydraulic fluid in the control line is less than the density of the fluid in the fluid column so that a closing biasing force is created by the heavier fluid column.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIGS. 1A, 1B, 1C, 1D, and 1E are continuations of each other and are fragmentary elevational views, partly in cross section, illustrating a well safety valve embodying the present invention, FIG. 2 is a cross-sectional view taken along the line 2—2 of FIG. 1A, and FIG. 3 is a cross-sectional view taken along the line 3—3 of FIG. 1B.

DESCRIPTION OF THE PREFERRED EMBODIMENT

Figure 1A:
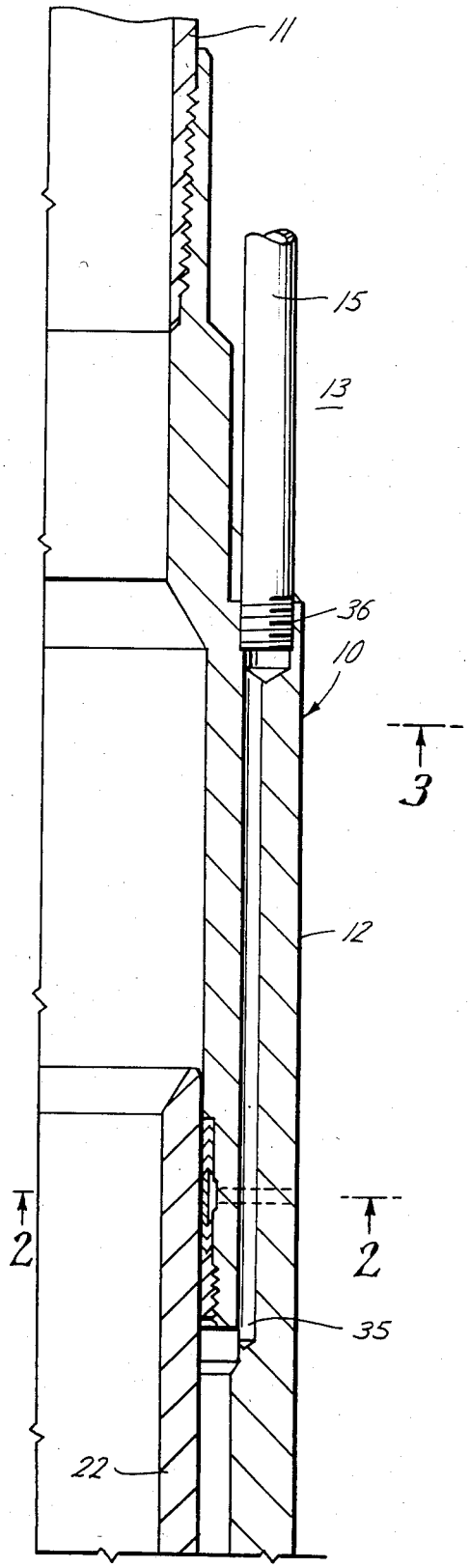

While the present invention will be shown in use in a subsurface well safety valve, for purposes of illustration only, it will be understood that the present invention may be used with other types of well tools which are actuated by a piston and cylinder assembly from a hydraulic fluid control line leading to the well surface.

Referring now to the drawings, particularly to FIGS. 1A–1E, the subsurface safety valve of the present invention is generally indicated by the reference numeral 10 and is shown as being of a non-retrievable type for connection in a well conduit or well tubing 11 such as by threaded connections. The safety valve 10 generally includes a tubular body or housing 12 adapted to be connected in a well tubing 11 to form a part thereof and to prevent the flow of well production upwardly therethrough under normal operating conditions. The safety valve 10 may close or be closed in response to abnormal conditions such as might occur when the well overproduces, blows wild or in the event of the failure of well equipment.

The safety valve 10 generally includes a bore 14, and as best seen in FIG. 1E, an annular valve seat 16 positioned about the bore 14, a valve closure element such as a flapper valve 18 connected to the body 12 by pivot pin 20 which is urged to a seating position by a spring 24. Thus, when the flapper valve 18 is in the upper position and seated on the valve seat 16, the safety valve 10 is in a closed position blocking flow upwardly through the bore 14. The sliding tube or tubular member 22 is telescopically movable in the body 12 and through the valve seat 16.

When the tubular member 22 is moved to a downward position, as best seen in FIG. 1E, the member 22 pushes the flapper 18 away from the valve seat 16. Thus the valve 10 is held in the open position so long as the tubular member 22 is in the downward position. When the tubular member 22 is moved upwardly, the flapper 18 is allowed to move upwardly onto the seat 16 by the action of the spring 24 and also by the action of the fluid flow moving upwardly through the well bore 14 of the body 12.

Various forces are provided to act on the tubular member 22 to control its movement so that under normal operating conditions the tubular member 22 will be moved to a downward position holding the flapper 18 away from and off of the valve seat 16 so that the valve 10 will be open. When desired, or when abnormal conditions occur, the tubular member 22 will be moved upwardly allowing the flapper 18 to close shutting off flow through the valve 10 and the well tubing 11. Thus, as best seen in FIG. 1D and 1E, biasing means such as a spring 26 or a pressurized gas chamber (not shown) may act between a shoulder 28 on the valve body 12 and a shoulder 30 connected to the tubular member 22 for yieldably urging the tubular member 22 in an upward direction to release the flapper 18 for closing the valve 10.

Figure 1B:
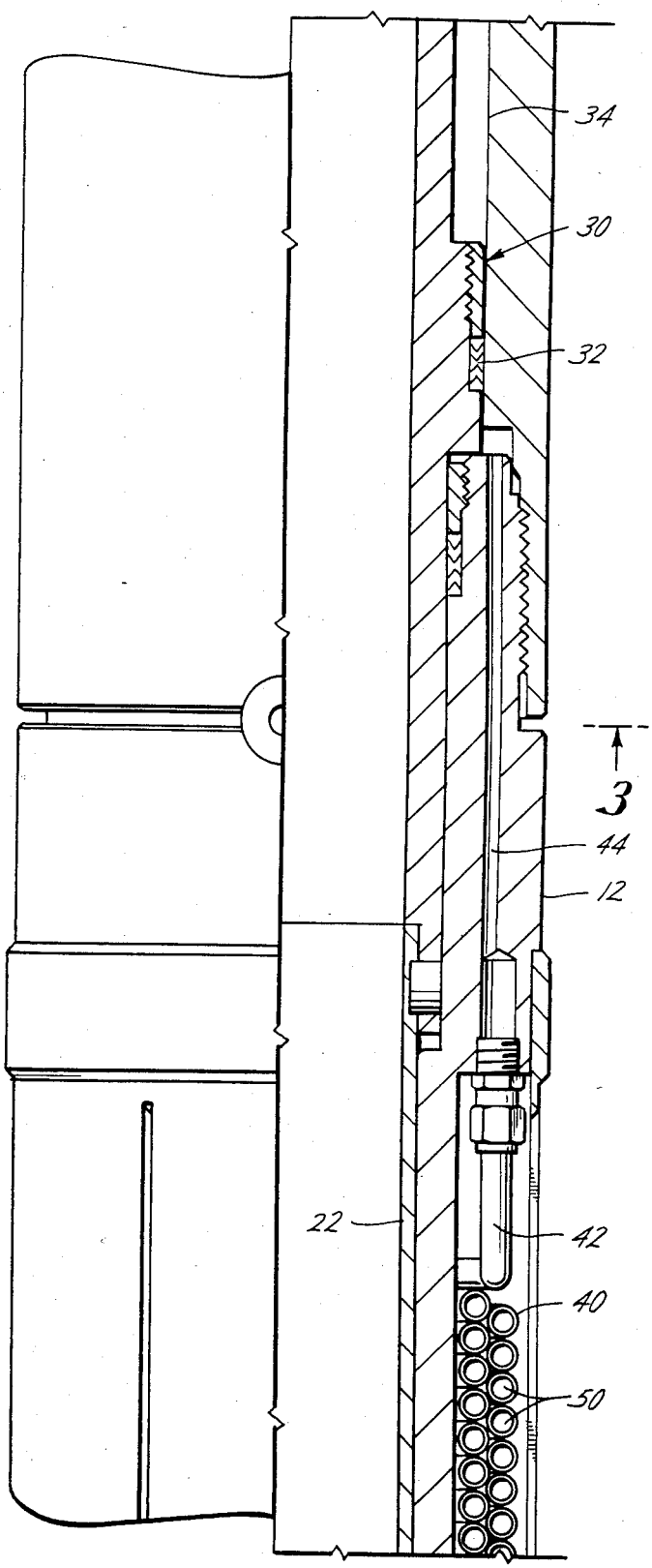

Referring now to FIGS. 1A and 1B, a piston and cylinder assembly, generally indicated by the reference numeral 30, is provided such as a piston 32 movable in a cylinder 34. For example, the piston 32 may be an annular piston telescopically moving in the annular cylinder 34. One side of the piston and cylinder assembly 30 is in communication through a passageway 35 with a port 36 which is adapted to be connected to a hydraulic control line 15 extending to the well surface for moving one of the piston 32 and cylinder 34, here shown as the piston 32, which is connected to the tubular member 22, in a direction for opening the valve 10. Release of the pressure in the line 15 allows the valve to be closed such as by spring 26.

However, it is desired that the safety valve 10 be set at great depths in the well, for example, 15,000 feet, which then creates a high hydrostatic fluid head in the line 15 acting on the piston and cylinder assembly 30 in a direction to open the valve 10. The greatest problem to overcome in most deep set safety valves is to provide a fail-safe valve, that is, one which will close when the actuating fluid pressure in the control line 15 is released. Pat. No. 4,161,219 describes a well safety valve in which the well or tubing pressure in the bore 15 acts on the second side of the piston and cylinder assembly and acts in a direction to close the valve. However, in designing a safety valve, the tubing pressure in the bore 15 is disregarded since it may not always be there or is variable. While a biasing spring such as 26 will act in a direction to close the safety valve, the maximum spring force that can be provided by spring 26 generally limits the valve to depths of approximately 10,000 feet. Another prior art solution to overcoming the high hydrostatic pressure in the control line 15 was to utilize a second hydraulic fluid balancing line which was exposed to the second side of the piston and cylinder assembly 30 and extends to the well surface. In theory, the balancing line provides an equal and opposite hydrostatic head acting on the piston and cylinder assembly 30 to offset the hydrostatic head in the line 15. However, if the seals isolating the second side of the piston and cylinder assembly fail, gas in the bore 14 would migrate to the balance line, and would lower the density of the hydraulic fluid in the balance line to such an extent that the balancing hydraulic fluid would not overcome the hydrostatic head in the line 15 and the valve would fail to close.

Figure 1C:
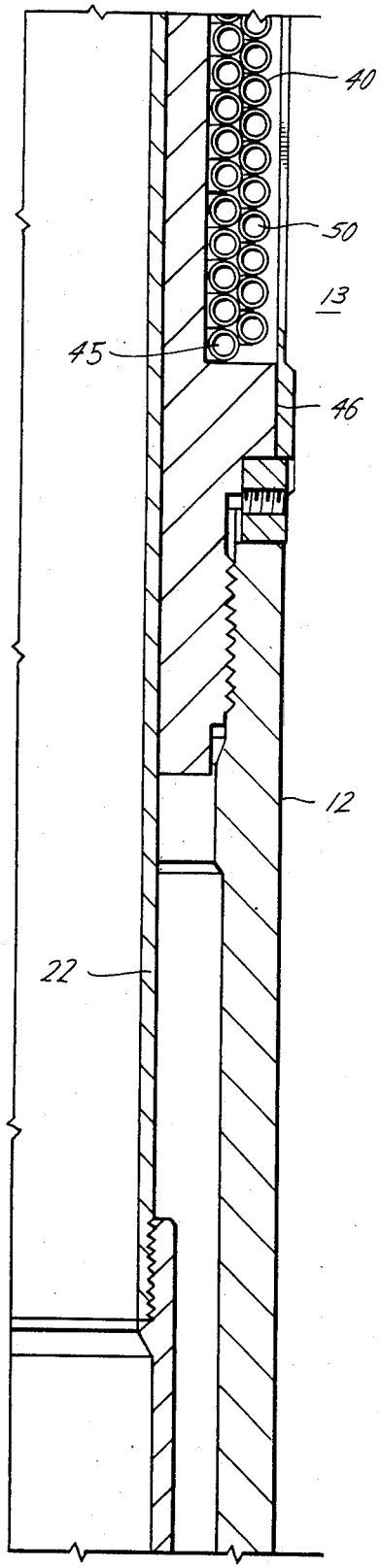
Figure 1D:
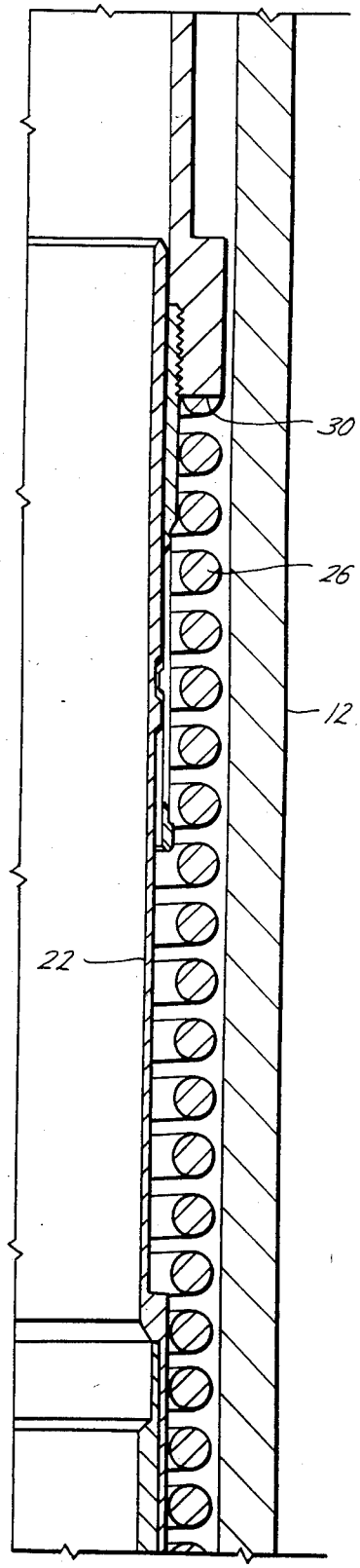

Therefore, one feature of the present invention is to provide a hydraulically actuated well valve or safety valve in which the second side of the piston and cylinder assembly 30 is exposed to a fluid column having substantially the same or greater hydrostatic head as the hydrostatic head in the control line 15, but in which the fluid column has a much greater volume of fluid than the volume of hydraulic fluid in the control line 15 whereby exposure of the fluid column to gas will not substantially change its density. Referring now to FIG. 1B and 1C, a container 40 such as a continuous tubular member has a first end 42 in communication with a passageway 44 which is in communication with the second side of the piston and cylinder assembly 30. The second end 45 of the tubular container 40 is exposed to the fluid in the annulus 13 about the valve 10 through a restriction 46 which allows fluid communication since there are no seals therein. Assuming that the annulus 13 about the housing 12 is open sea water, the height of the head of the sea water will be approximately equal to the height of the head in the hydraulic fluid control line 15. However, because the volume of the sea water in the annulus 13 surrounding the valve 10 is much greater than the volume of the hydraulic fluid in the control line 15, any failure of any seals in the valve 10 which would allow gas from the tubing 11 to leak into the annulus 13 would not be of a sufficient amount to dilute the density of the sea water sufficiently to affect its balanacing effect on the piston and cylinder assembly 30. Furthermore since the sea water is denser or heavier than the hydraulic fluid in the control line 15, that is hydraulic oil has approximately 0.36 psi/foot hydrostatic head while sea water has approximately 0.45 psi/foot hydrostatic head, the sea water will always provide a biasing closing means along with the power spring 26. However, even assuming that the annulus 13 is an enclosed annulus between the safety valve 10 and a well casing (not shown) the volume would be many times the volume of the hydraulic control line 15 and the fluid column in the annulus 13 would not have its density lowered to any extent by any gas leakage thereto. Furthermore, in the case of an enclosed annulus 13 the density of the fluid column in the annulus would have a much greater density than the density of the hydraulic control fluid in the line 15. For example, the annulus 13 in an enclosed system could use even heavier fluids than normal such as calcium chloride or bromide which have hydrostatic gradients of approximately 0.6 psi/feet which would create a closing force on the hydraulic piston and cylinder assembly 30.

Although the components of the hydraulic piston and cylinder assembly 30 are manufactured of non-corrosive materials, it is desirable to prevent foreign materials and/or sea water from contaminating the assembly 30, yet utilize the pressure created by the hydrostatic head in the annulus 13. Therefore, the compartment or tube 40 is filled with a grease 50 both for lubrication purposes and to act as a barrier against the fluid column in the annulus 13. The restriction 46 acts to retain the grease 50 in position. One suitable grease is Type Moly, Lithiumiz Hydroxy manufactured by Hunter Chemicals. The grease 50 in the interior of the compartment 40 will move up and down in the compartment 40 as the piston and cylinder assembly 30 is actuated. Therefore, the volume of fluid being displaced by the actuation of the piston and cylinder assembly 30 should be less than half of the volume of the compartment 40 to insure that the grease remains positioned between the annulus 13 and the assembly 30 during operation. In addition, the grease, which has a density less than water, or the fluid column in the annulus 13, will not have a tendency to sink into the annulus 13, but will instead float on the fluid in the fluid column entering the compartment 40.

The method of the present invention is apparent from the foregoing description of the preferred embodiment. However, the method comprehends compensating for the effects of the hydrostatic head on a well tool operated in a well by a piston and cylinder assembly and actuated by a hydraulic fluid control line connected to one side of the assembly and extending to the well surface. The method includes exposing the second side of the assembly to a fluid column having substantially the same hydrostatic head as the head in the control line and in which the fluid column has a greater volume of fluid than the volume of hydraulic fluid in the control line whereby exposure of the fluid column to well gas will not substantially change its density. The method further comprehends that the density of the fluid column is greater than the density of the hydraulic fluid in the control line thereby providing not only a compensating force but a biasing force acting on the piston and cylinder assembly. The method further includes placing a barrier fluid between the second side of the assembly and the fluid column for protecting the assembly from the fluid in the fluid column. In addition, the volume of the barrier fluid is greater than the volume displaced by actuation of the piston and cylinder assembly for maintaining the barrier fluid in position between the assembly and the fluid column. The method further comprehends wherein the density of the barrier fluid is less than the density of the fluid in the fluid column whereby the denser fluid column will maintain the barrier fluid in position.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a well safety valve for controlling the fluid flow through a well conduit and including a tubular housing and a valve closure member moving between open and closed positions, a piston and cylinder assembly positioned in the housing and connected to the valve closure member for moving the valve closure member, one side of the assembly adapted to be connected to a hydraulic control line extending to the well surface for moving the valve closure member to the open position, the improvement in means for compensating for the hydrostatic pressure in the control line comprising, a container in the housing in communication between the other side of the assembly and outside of the housing and adapted to being exposed to a fluid column outside of the housing extending to the well surface for hydrostatically compensating for the hydrostatic pressure in the control line, and barrier fluid in the container for limiting the access of the fluid with the assembly, said container having a restriction between the barrier fluid and the outside of the housing for retaining the barrier fluid in the container.

2. The apparatus of claim 1 wherein the volume of the container is greater than the volume displaced in the assembly upon actuation of the piston and cylinder.

3. The apparatus of claim 2 wherein the density of the barrier fluid is less than the density of the fluid in the fluid column.

4. The apparatus of claim 3 wherein the density of the hydraulic fluid in the control line is less than the density of the fluid in the fluid column.

5. The apparatus of claim 1 wherein the container includes a tubular member.

6. The method of compensating for the effects of hydrostatic head on a well tool operated in a well by a piston and cylinder assembly and actuated by a hydraulic fluid control line connected to one side of the assembly and extending to the well surface and comprising, exposing the second side of the assembly to a fluid column outside of the well tool having substantially the same hydrostatic head as the head in the control line, and the fluid column having a greater volume of fluid than the volume of hydraulic fluid in the control line whereby exposure of the fluid column to gas will not substantially change its density.

7. The method of claim 6 wherein the density of the fluid column is greater than the density of the hydraulic fluid in the control line thereby providing a biasing force acting on the piston and cylinder assembly.

8. The method of claim 6 including, placing a barrier fluid between the second side of the assembly and the fluid column for protecting the assembly from the fluid in the fluid column.

9. The method of claim 8 wherein the volume of barrier fluid is greater than the volume displaced by actuation of the piston and cylinder assembly.

10. The method of claim 9 wherein the density of the barrier fluid is less than the density of the fluid in the fluid column.

* * * * *